US010830425B2

(12) United States Patent
Hammer et al.

(10) Patent No.: US 10,830,425 B2
(45) Date of Patent: Nov. 10, 2020

(54) LIGHTING DEVICE

(71) Applicant: OSRAM GmbH, Munich (DE)

(72) Inventors: Andreas Hammer, Regensburg (DE); Antje Graichen, Lappersdorf (DE); Simon Lankes, Regensburg (DE); Stephan Janka, Regensburg (DE)

(73) Assignee: Osram GmbH, Munich (DE)

( * ) Notice: Subject to any disclaimer, the term of this patent is extended or adjusted under 35 U.S.C. 154(b) by 221 days.

(21) Appl. No.: 16/065,159

(22) PCT Filed: Oct. 28, 2016

(86) PCT No.: PCT/EP2016/076146
§ 371 (c)(1),
(2) Date: Jun. 22, 2018

(87) PCT Pub. No.: WO2017/108238
PCT Pub. Date: Jun. 29, 2017

(65) Prior Publication Data

US 2019/0011117 A1 Jan. 10, 2019

(30) Foreign Application Priority Data

Dec. 23, 2015 (DE) ..... 10 2015 226 670

(51) Int. Cl.
*F21V 15/00* (2015.01)
*F21V 23/00* (2015.01)
(Continued)

(52) U.S. Cl.
CPC ..... *F21V 23/009* (2013.01); *F21V 15/01* (2013.01); *F21V 23/003* (2013.01);
(Continued)

(58) Field of Classification Search
CPC .... F21V 23/008; F21V 23/009; F21V 23/003; F21V 23/06; F21V 23/023; F21V 15/01
(Continued)

(56) References Cited

U.S. PATENT DOCUMENTS

2010/0109530 A1 5/2010 Eckel et al.
2013/0021792 A1* 1/2013 Snell ..... F21V 7/0016 362/218

(Continued)

FOREIGN PATENT DOCUMENTS

DE 29810384 U1 9/1998
DE 19849878 A1 5/2000

(Continued)

OTHER PUBLICATIONS

German Search Report based on application No. 10 2015 226 670.2 (7 pages) dated Jul. 21, 2016 (for reference purpose only).

(Continued)

*Primary Examiner* — Ali Alavi
(74) *Attorney, Agent, or Firm* — Viering, Jentschura & Partner mbB

(57) ABSTRACT

A lighting device, comprising a power setting unit for setting an electrical power of a light source electrically coupled to the power setting unit, a programmable control unit connected to the power setting unit for controlling the power setting unit, a light control interface unit connected to the control unit for supplying a control signal, and a housing made of an electrically insulating material, which provides a power connection for connecting to an electrical power supply network. The housing encloses at least the power setting unit and the control unit so that they are protected. The control signal is predefinable via the light control interface from outside the housing. The control unit provides a programming interface having at least two contact surfaces (Continued)

for electrically contacting the programming interface and an isolation unit for the programming interface and the housing has a passage opening in a housing wall for each contact.

14 Claims, 3 Drawing Sheets

(51) Int. Cl.
*F21V 15/01* (2006.01)
*F21V 23/06* (2006.01)
*F21V 23/02* (2006.01)

(52) U.S. Cl.
CPC ..... *F21V 23/008* (2013.01); *F21V 23/023* (2013.01); *F21V 23/06* (2013.01)

(58) Field of Classification Search
USPC ..... 362/362
See application file for complete search history.

(56) References Cited

U.S. PATENT DOCUMENTS

2013/0039055 A1* 2/2013 Wilson ..... B60Q 3/74 362/235
2013/0099699 A1* 4/2013 Suzuki ..... H05B 45/37 315/307
2016/0327255 A1 11/2016 Wittmann

FOREIGN PATENT DOCUMENTS

DE 102014000885 A1 7/2015
WO 2015104279 A1 7/2015

OTHER PUBLICATIONS

International Search Report based on application No. PCT/EP2016/076146 (6 pages + 3 pages English translation) dated Dec. 22, 2016 (for reference purpose only).

* cited by examiner

LIGHTING DEVICE

CROSS-REFERENCE TO RELATED APPLICATIONS

The present application is a national stage entry according to 35 U.S.C. § 371 of PCT application No.: PCT/EP2016/076146 filed on Oct. 28, 2016, which claims priority from German Patent Application Serial No.: 10 2015 226 670.2 which was filed Dec. 23, 2015, and is incorporated herein by reference in its entirety and for all purposes.

SUMMARY

The present description relates to a lighting device, in particular for building lighting, including a power setting unit for setting an electrical power of a lighting means which is or may be electrically coupled to the power setting unit, a programmable control unit connected to the power setting unit for controlling the power setting unit, a light control interface unit connected to the control unit for supplying a control signal for setting the power of the power setting unit, and a housing made of an electrically insulating material, which provides a power connection for connecting to an electrical power supply network, to which the power setting unit is connected, and which housing encloses at least the power setting unit and the control unit so they are protected against touching, wherein the control signal is predefinable via the light control interface from outside the housing.

Lighting devices of the type in question may typically be used in building lighting, in which lighting means are supplied with electrical energy from the public power supply network, for example, at a nominal voltage of 230 V and at a network frequency of 50 Hz. For this purpose, the lighting device has the power setting unit, which may include a clocked energy converter, for example. The power setting unit acquires energy from the power supply network and supplies it in a predefinable manner to the lighting means, which converts the supplied electrical energy into light energy and emits it. In addition to incandescent lamps and gas discharge lamps, light-emitting diodes, for example, light-emitting diode arrangements made of a plurality of individual light-emitting diodes, and/or the like are used in particular as lighting means. The electrical power supplied to the lighting means may be set using the power setting unit, and therefore in this way the luminosity emitted by the lighting means may also be set accordingly as a consequence. For this purpose, the power setting unit may be coupled to the control unit and receives corresponding power control signals from the control unit.

The control unit may, in turn, be connected to a light control interface unit used to supply a control signal for setting the power of the power setting unit. The control signal is predefinable via the light control interface from outside the housing. The light control interface unit is, for example, formed by a manually actuable setting element, by means of which a corresponding control signal may be generated and supplied to the control unit as a result of a manual actuation. In addition, of course, an electrical signal supply to the control unit may also be produced, for which purpose the light control interface unit may be designed as a digital addressable lighting interface (DALI) or the like.

At least the power setting unit and the control unit may be arranged in a housing made of an electrically insulating material. Plastic is frequently used as the material, wherein a wall thickness of the housing is selected such that, in addition to mechanical requirements, sufficient electrical insulation may be achieved. The housing furthermore provides a power connection for connecting to the electrical power supply network. The connection may be formed, for example, by a cable including a plug, but also by a plug unit which may be integrated into the housing. In addition, of course, the possibility exists of providing a terminal block, to be able to connect connection lines to the public power supply network.

The housing may be designed to enclose at least the power setting unit and the control unit so that they are protected from touch. In this way, the lighting device may be safely handled not only when it is not electrically coupled to the power supply network, but rather when also it is in the intended operation. The housing thus ensures that a user who wishes to handle the lighting device is protected during a conventional handling situation from the electrical potentials which may occur in the lighting device. The corresponding requirements result, for example, from standards, thus here in particular EN 60 598 and also EN 60 335 and others.

In order that the touch protection may be ensured for the provided usage duration of the lighting device, the housing is designed such that it is exclusively to be opened by damaging it. The housing thus cannot be opened nondestructively here. It may therefore also be ensured in the event of possible unintended handling by the user that improper interventions in the lighting device may be substantially avoided or are, however at least obvious.

The control unit is generally designed as a programmable control unit, i.e., it includes, for example, a programmable computer unit, thus, for example, in the form of a microprocessor or the like. The lighting device may thus be adapted with respect to its function to a plurality of applications. It may be provided for this purpose, for example, that the microprocessor is programmed before it is installed in the control unit. After the programmed microprocessor is arranged in the control unit, the housing is then arranged closed around the control unit and the power setting unit, and therefore it may no longer be opened. The control unit generates, on the basis of the control signals received via the light control interface unit, the power control signals which are transmitted to the power setting unit and by means of which the power setting unit sets a power to be emitted to the lighting means. In particular, it generates the power control signals with at least partial use of the programmable computer unit. The control unit may additionally, of course, also have a hardware circuit, which may also take part in the generation of the power control signals.

Although these lighting devices have proven themselves in the prior art, disadvantages have nonetheless been shown. For example, it has proven to be problematic that after the attachment of the housing, an engagement in the lighting device, in particular with respect to its functionality, is no longer possible. This is shown in particular in the case of maintenance if, for example, an adaptation of a programming nature is advantageously to be performed. In this case, it is then necessary to completely replace the lighting device with a new one, which is programmed accordingly.

The description is therefore based on the object of refining a lighting device of the type in question such that it may be designed more flexibly.

In a lighting device of the type in question, it may be, in particular, that the control unit provides a programming interface including at least two contact surfaces for electrically contacting the control unit and an electrical potential isolation for the programming interface and the housing has an associated passage opening in a housing wall for each contact surface, which opening is arranged opposite to the associated contact surface, wherein each passage opening has a diameter of less than or equal to 2.5 mm and a respective passage opening wall of the passage opening has an axial length of greater than or equal to 3 mm, preferably greater than or equal to 4 mm.

The description therefore provides, not only a programming interface, which would typically infringe the requirements with respect to the electrical safety, but rather it also takes into consideration the special requirements with respect to the electrical safety by way of its particular design, by the programming interface taking into consideration specified requirements of both an electrical and also a mechanical nature in the implementation thereof. Although these strict requirements are implemented, nonetheless a reliable function of the programming interface may still be achieved. This is achieved in particular by the passage openings in the housing directly opposite to the contact surfaces, because in this way—in contrast to the case of plug connections based on contact sleeves and contact pins—a contact only takes place in the housing interior at the end of the passage opening. Since the passage opening itself is provided by the housing, which is formed from an insulating material, the passage opening is also formed from an insulating material. A creepage distance and an air gap are thus defined by an axial length of the passage opening, and therefore the minimum distances provided by the standards may be reliably implemented by the axial length of the passage opening. At the same time, it may be ensured by the provided selection of the diameter of the passage opening that the requirements with respect to the touch protection may also be fulfilled according to the standards. The passage opening may be designed as a borehole and the passage opening wall may be designed as a borehole wall.

Thus, the contact surfaces to be contacted from the outside through the passage openings in a simple manner by means of suitable, adapted contact pins, and therefore a contact to be able to be established to the programming interface of the control unit and corresponding programming to be able to be performed. Such programming may be, for example, the uploading of updates, the reprogramming of the control unit, in particular the microprocessor, but also the modification and/or adaptation of parameters, and/or the like. An already produced lighting device may be adapted later in an intended manner, without having to perform interventions on the housing, which could impair the electrical safety.

For example, the housing may be secured against unauthorized opening, wherein it is not necessary to engage in the housing itself to perform the programming of the control unit later. Of course, the housing may also be secured against unauthorized opening in other ways, for example, by providing that a special tool is necessary to open the housing, only trained personnel have the required knowledge of how the housing may be opened, in particular nondestructively, and/or the like. In addition, it may be provided that the housing is secured against unauthorized opening only after an installation, in particular in an installed state, for intended operation.

The housing may exclusively be opened by damaging it. In this case, the housing does not have to be damaged for the purpose of programming, because an access to the programming interface accessible via the passage opening is possible. In the prior art, the housing instead has to be destroyed and then the entire housing has to be replaced. This may be saved by the invention.

In addition, the lighting devices may be able to be produced independently of the later application thereof and only provided with a programming of the control unit when they are to be delivered. This enables customer-specific lighting modules to be provided and delivered with little effort from the warehouse. The lighting devices may therefore be produced non-specifically, i.e., even without programming.

Finally, a test programming may be provided in the control unit during the production of the lighting device, which enables the lighting device to be tested with respect to its functionality during the production process, without separate external interventions being required for this purpose and/or by corresponding testing processes being able to be reduced with respect to the effort thereof. After completed positive testing of the produced lighting device, the upload of the program for the intended function of the lighting device may then take place later via the programming interface. This also enables in particular the tests with respect to the electrical safety, as are specified, for example, in standard EN 60 335, to be carried out properly. This functionality is no longer required for the later intended operation of the lighting device.

The programming interface may have two contact surfaces. In addition, however, it may also have three, four, or more contact surfaces, depending on how the programming interface is designed with respect to hardware. For example, it may be provided that the programming interface has four contact surfaces, with which four passage openings of the housing are associated. It may be provided, for example, that two of the four passage openings are used for the purpose of applying electrical energy to the programming interface from the outside, while in contrast two further contact surfaces are used to perform the programming by means of data transfer.

In order that the programming may be performed harmlessly, the potential isolation unit is furthermore provided in the control unit, which is used to ensure that the programming interface is accessible without potential from the outside. It is thus possible to be able to perform the programming even during the intended operation of the lighting device. The potential isolation unit may have for this purpose, for example, one or more optocouplers, one or more transformers, and/or the like.

One refinement provides that the lighting device has a connection unit, which is connected to the power setting unit, for the lighting means. The lighting means may be connected in this case as a separate device to the lighting device. The connection unit for the lighting means is formed integrated in the housing, like the power connection. The connection unit for the lighting means may accordingly be designed as a socket, plug, or the like.

However, it may also be provided that the connection unit is formed by a cable having a socket or a plug, respectively. This embodiment enables the lighting means and the lighting device to be arranged spatially separated from one another, for example, in the case of very constricted spatial conditions, in the case of unfavorable atmospheric conditions, and/or the like.

The lighting means is may be arranged in the housing and the housing has a light outlet opening for letting through light generated by the lighting means. An integrated structural unit may thus be provided, which is simple to handle. In addition, it may be ensured that the lighting device cannot be damaged by connecting an unsuitable lighting means. Moreover, this also applies in the inverse case, specifically if an unsuitable lighting means is connected to the lighting device, which is in turn not designed for the operation on the lighting device.

Furthermore, it may be provided that the passage opening has a passage opening orifice, which is arranged directly adjacent to the respective associated contact surface. Guiding of the contact pin for contacting the contact surface may thus be provided by means of the passage opening. This improves the reliability of the usage of the programming interface. At the same time, in particular if the contact surface extends at least over the diameter of the passage opening, a reliable contact of the contact surface may be achieved. At the same time, an undesired contact outside the contact surface may be avoided.

In one advantageous embodiment, it is proposed that the contact surfaces and at least partially the control unit are arranged on a separate potential-isolated assembly carrier. The assembly carrier may be designed, for example, as a printed circuit board or the like, on which the corresponding components of the control unit and the programming interface are arranged. An improved situation with respect to the electrical safety may be achieved by the separate, potential-isolated assembly. In addition, this facilitates the design, in particular with respect to the programming interface, because the arrangement of the programming interface in the lighting device may be designed more freely due to the separate assembly. At the same time, the least possible distance may exist between the passage opening orifice and the contact surface, because an arrangement in the housing may be achieved with reduced requirements. In particular, the assembly carrier may be arranged independently of the power setting unit. Under certain circumstances, as a separate assembly carrier this only requires simplified requirements to be maintained with respect to the electrical safety.

According to a further embodiment, the contact surface closes the passage opening orifice. For this purpose, for example, the contact surface may press against the entire cross section of the passage opening in the region of the orifice. This has the advantage that possible soiling, which may enter the passage opening during the intended operation of the lighting device, cannot also enter the interior of the housing at the same time and thus cannot impair the intended operation of the lighting device. This is prevented by the closing of the passage opening by the contact surface. It may particularly advantageously be provided for this purpose that the contact surface presses against the passage opening and/or is connected thereto via a seal element. At the same time, the housing may thus also be used for holding the assembly carrier at least in the region of the passage opening. Furthermore, even in the event of a large force action of contact pins on the contact surfaces, damage or other mechanical effects on the programming interface and the contact surfaces thereof may thus be reduced or even avoided.

Advantageously, the passage opening may be formed as at least partially circular-cylindrical. The passage opening may thus be produced in a particularly simple manner. Alternatively, however, it may also have a cross section deviating from the circular shape, for example, elliptical, polygonal, and/or the like. This enables a coding to be provided, in particular if the passage openings have different diameters, and therefore with appropriately adapted coding pins, a correct association of the connections of the programming interface with an external programming device may be facilitated. A shape of the diameter of the passage opening may also additionally be adapted to a shape of a contact pin, for example, which is provided for the purpose of contacting the contact surface through the passage opening.

Furthermore, it may be provided that the passage opening is at least partially conically formed such that an internal diameter of the passage opening decreases in the direction of the contact surface. An additional guiding effect during the insertion of the contact pins into the passage openings may thus be achieved. At the same time, this embodiment enables an outer passage opening orifice on the housing exterior to be designed as larger, to facilitate an insertion of the contact pins into the passage openings, in particular if a plurality of contact surfaces are to be contacted by means of an adapter bearing corresponding pins.

According to a further embodiment, it is proposed that the passage opening wall has at least one circumferential step, which protrudes radially inward. This embodiment enables the creepage distance along the passage opening wall to be lengthened in the axial direction of the passage opening. The step is particularly advantageously selected such that at an axial length of the passage opening which meets the requirements with respect to the air gap, the requirements with respect to the creepage distance are also fulfilled at the same time. It may be provided that two or more corresponding steps are provided, which cause a stepped taper in the direction of the contact surface, for example. In addition, of course, the possibility also exists of providing the passage opening wall with a thread, to lengthen the creepage distance.

A further embodiment proposes that the passage opening wall has a coating which increases a leakage current resistance. This embodiment has proven to be advantageous, in particular, if atmospheric conditions, for example, precipitation, may occur in the region of the passage opening and a leakage current resistance may thus be decreased. This may be reduced by a suitable coating, for example, by a corresponding suitable lacquering or the like as is also used, for example, in printed circuit boards.

Furthermore, the passage opening may have a sleeve formed with the housing, which extends from the housing wall in the direction of the contact surface. This embodiment has the advantage that the housing has to be designed with respect to its wall thickness solely in regard to mechanical requirements and insulation requirements. The wall thickness is, therefore, typically substantially less than would be required to implement the required minimum length for the air gap and creepage distance using the passage opening. To conserve in the case of the housing material and be able to obtain structural space at the same time, it is therefore provided, according to this embodiment, that the passage opening is accordingly lengthened by a sleeve, by means of which the corresponding requirements with respect to diameter and length may be fulfilled. The sleeve may be integrally formed with the housing and from the same material. However, it may also be formed as a separate component and may be arranged adjoining the passage opening in the region of the passage opening in the housing wall, and therefore it lengthens the passage opening of the housing in a predefined manner. For example, it may be adhesively bonded or welded or the like onto the housing inner side. The sleeve is also formed from an electrically insulating material like the housing.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings in which.

DETAILED DESCRIPTION

Figure 1:
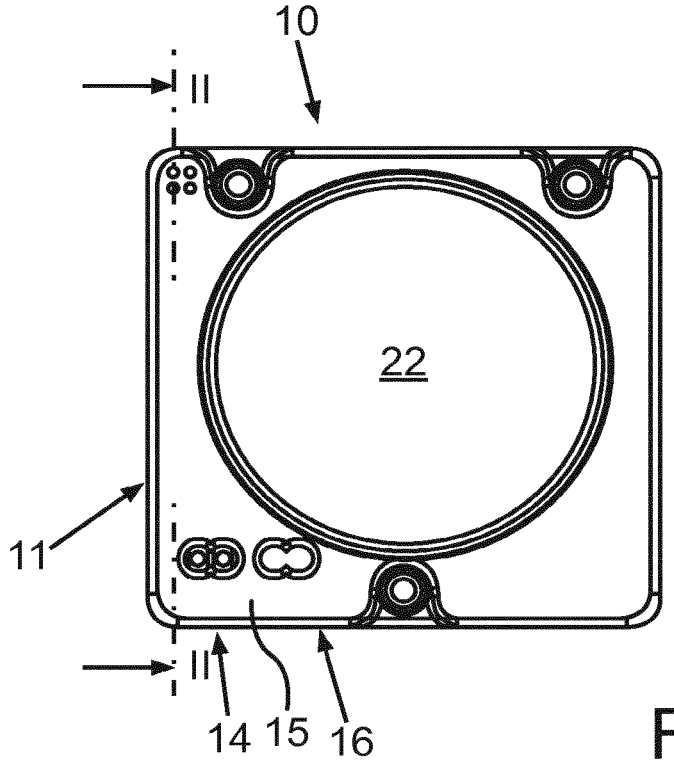
FIG. 1 shows a schematic top view of a light module as a lighting device according to the description.

FIG. 1 shows a schematic illustration in a top view of a light module 10 as a lighting device, as is used in the present case for building lighting, in particular interior lighting. The light module 10 includes a power setting unit 11 (FIG. 3) for setting an electrical power of a light-emitting diode arrangement 12 electrically coupled to the power setting unit 11 as the lighting means. The light module 10 furthermore includes a programmable control unit 13 for controlling the power setting unit 11. Furthermore, the light module 10 includes a DALI interface 14 connected to the control unit 13 as a light control interface unit for supplying a control signal for setting the power of the power setting unit 11. Finally, the light module 10 includes a housing 15 made of an electrically insulating material, in the present case a plastic such as PET or the like.

The housing 15 provides a power connection 16 for connection to an electrical power supply network, the public power supply network here. The power setting unit 11, which acquires electrical energy for the intended operation of the light module 10 via the power connection 16, is connected in the housing interior to the power connection 16. The housing 15 encloses the power setting unit 11 and the control unit 13 including the programming interface 27 and the light-emitting diode arrangement 12 in a manner protected from touch in the present case. The housing 15 is secured in a manner not shown in greater detail against unauthorized opening, by only being able to be opened by its destruction in the present case.

The control unit 13 is connected to the power setting unit 11 and provides a power control signal, by means of which an electrical power results at the power setting unit 11, which is emitted to the light-emitting diode arrangement 12. Furthermore, the control unit 13 includes a potential isolation unit 18 and a programming interface 27. The potential isolation unit 18 enables an electrical isolation in relation to the power setting unit 11 and/or the units connected to the power connection 16 to be provided.

In the present case, the programming interface 27 has four contact surfaces 17, via which programming of the control unit 13 may be performed. For this purpose, the control unit 13 has a microprocessor (not shown in greater detail). The contact surfaces 17 are arranged on a printed circuit board 24 as the assembly carrier of the control unit 13.

The housing 15 has a housing wall 19, in which the power connection 16 is arranged in an integrated manner, as is the DALI interface 14. Sealing of the housing 15 may thus be achieved in the region of the power connection 16 and the DALI interface 14.

The housing wall 19 has an associated borehole 20 as a passage opening for each contact surface 17, which is arranged opposite to the respective associated contact surface 17. Each of the boreholes 20 has a diameter of 1.5 mm. Furthermore, each borehole 20 has a respective borehole wall 21 as the passage opening wall, wherein an axial length of the borehole 20 is 3.1 mm.

The housing 15 furthermore includes a light exit opening 22 for letting through light generated by the light-emitting diode arrangement 12.

Each borehole 20 has a borehole orifice 23 as a passage opening orifice, which is arranged directly adjacent to the respective associated contact surface 17. Furthermore, the boreholes 20 are formed conically in the present case, and therefore an internal diameter of the boreholes decreases in the direction of the contact surfaces 17. Guiding of contact pins to be inserted is achieved in this way, which may therefore be supplied reliably to the contact surface when they are inserted into the boreholes 20.

Figure 4:
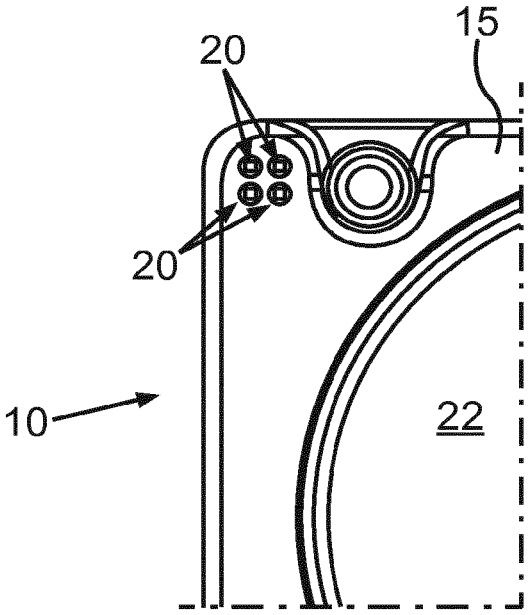
FIG. 4 shows an enlarged illustration of a left upper detail from the light module according to FIG. 1.
Figure 5:
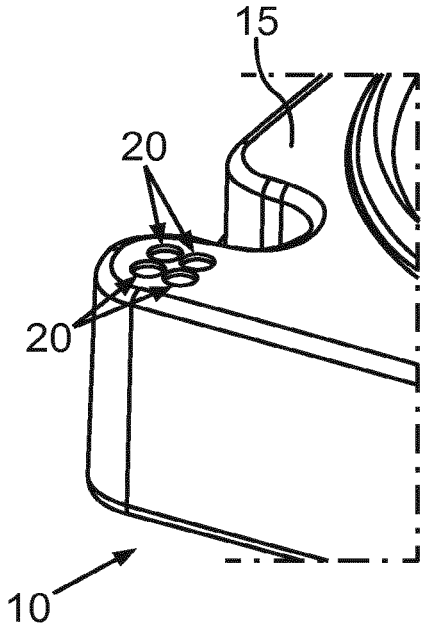
FIG. 5 shows a perspective view of the detail according to FIG. 4.

It is apparent in the present case from FIGS. 4 and 5 that the boreholes 20 have a sleeve 25 integrally formed with the housing 15, which extend from the housing wall 19 in the direction of the contact surfaces 17. The housing 15 thus does not have to be formed with respect to its thickness over the required extension of the borehole. Material may thus be conserved with respect to the housing 15 and structural space may be provided.

Printed circuit boards having programmable logic controllers in a housing, which may no longer be opened nondestructively after assembly, may therefore be tested or programmed later, for example, in the case of troubleshooting or in the case of updates. In this manner, even after complete assembly of the housing 15 and/or the light module 10, testing, programming, and also an update may be carried out. The contacting required for this purpose may take place automatically by means of an adapter, which has corresponding contact pins. It may be provided for this purpose, for example, that a movable contact adapter holds correspondingly arranged testing pins and is moved by a suitable guide, for example, by means of a robot arm or the like, into a contact position with the programming interface 27, to be able to perform corresponding programming or testing, respectively, after the contact is established. For this purpose, the contact pins may be mounted spring-loaded on the adapter and may have tips formed appropriately for reliable contacting.

Figure 2:
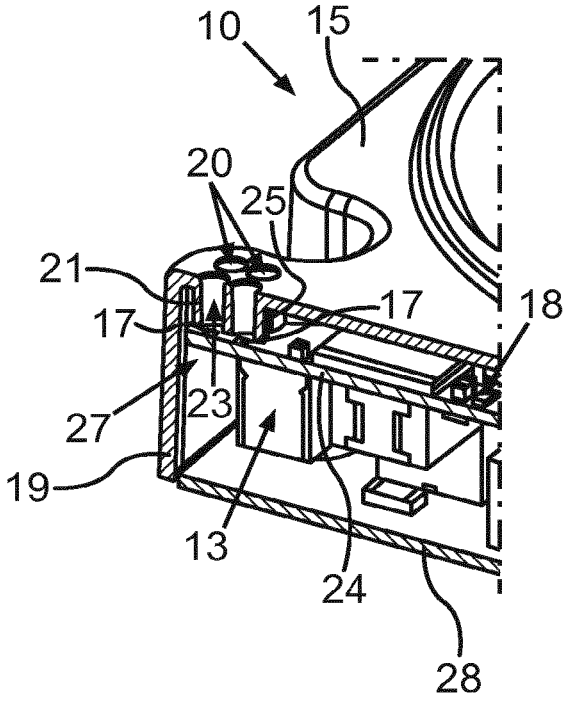
FIG. 2 shows a detail of a perspective side view of the light module according to FIG. 1 along a section line II-II.
Figure 3:
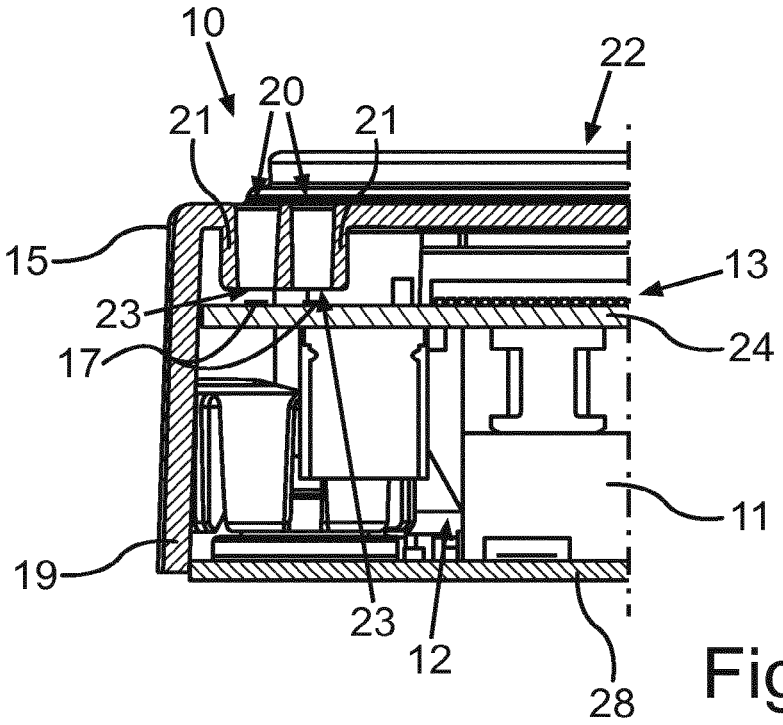
FIG. 3 shows an enlarged side view of a detail of the view in FIG. 2.

The control unit 13 having the programming interface 27 and the contact surfaces 17 is arranged on the printed circuit board 24 as a separate assembly carrier. This printed circuit board 24 is arranged offset in relation to a printed circuit board 28 which bears the components of the power setting unit 11, in the present example above the printed circuit board 28 (FIGS. 2, 3). The potential isolation unit 18 is arranged on the assembly carrier 24 in a connecting region between the assembly carrier 24 and the printed circuit board 28. Alternatively, however, it may also be arranged on the printed circuit board 28 in the region of the electrical connection. The assembly carrier 24 may thus be formed completely isolated from the electrical potential on the printed circuit board 28. Advantages result in this way with respect to requirements regarding the electrical safety.

Furthermore, by way of the embodiment of the programming interface 17, undesired accesses to the control unit 13 are made more difficult, because electrical contacting by means of contact pins is required for this purpose. This also distinguishes the description in relation to a solution which would enable wireless programming. Moreover, in relation to wireless programming, for example, by means of radio, infrared, or the like, it is not possible to engage in an interfering and undesired manner during the programming, so that the programming result is faulty.

The non-limiting embodiment is merely used by way of explanation and is not restrictive for the latter. Thus, of course, functions, the construction of the housing, and the selection of the materials and further features may be designed arbitrarily, without leaving the concept of the description.

In addition, of course, the invention may be used not only inside buildings for the lighting thereof, but rather also in an outside region, in particular in the region of buildings, for example, for lighting a path, a road, a working region, and/or the like. The lighting device may therefore also be an exterior light, a streetlamp, and/or the like. In this case, the housing may also be formed hermetically sealed, in particular against a penetration of liquids, gases, solid particles, and/or the like.

While the invention has been particularly shown and described with reference to specific embodiments, it should be understood by those skilled in the art that various changed in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SIGNS

10 light module
11 power setting unit
12 light-emitting diode arrangement
13 control unit
14 DALI interface
15 housing
16 power connection
17 contact surface
18 potential isolation unit
19 housing wall
20 borehole
21 borehole wall
22 light exit opening
23 borehole orifice
24 printed circuit board
25 sleeve
27 programming interface
28 printed circuit board

The invention claimed is:

1. A lighting device, comprising:

a power setting unit for setting an electrical power of a light source electrically coupled to the power setting unit, a programmable control unit connected to the power setting unit for controlling the power setting unit, a light control interface unit connected to the control unit for supplying a control signal for setting the power of the power setting unit, and a housing made of an electrically insulating material, which provides a power connection for connecting to an electrical power supply network, and which housing encloses at least the power setting unit and the programmable control unit so that they are protected from touch, wherein the control signal is predefinable via the light control interface from outside the housing, wherein the programmable control unit comprises:

a programming interface having at least two contact surfaces for electrically contacting the programming interface, an isolation unit configured to electrically isolate the programming interface from the power setting unit; and wherein the housing has an associated passage opening in a housing wall for each contact surface arranged opposite to the associated contact surface, wherein each passage opening has a diameter of less than or equal to 2.5 mm and a respective passage opening wall of the passage opening has an axial length of greater than or equal to 3 mm.

2. The lighting device as claimed in claim 1, further comprising a connection unit, which is connected to the power setting unit, for the light source.

3. The lighting device as claimed in claim 1, wherein the light source is arranged in the housing and the housing has a light exit opening for letting through light generated by the light source.

4. The lighting device as claimed in claim 1, wherein the passage opening has a passage opening orifice arranged directly adjacent to the respective associated contact surface.

5. The lighting device as claimed in claim 4, wherein the contact surfaces and at least partially the control unit are arranged on a separate potential-isolated assembly carrier.

6. The lighting device as claimed in claim 4, wherein the contact surface closes the passage opening orifice.

7. The lighting device as claimed in claim 1, wherein the passage opening is formed at least partially circular-cylindrical.

8. The lighting device as claimed claim 1, wherein the passage opening is formed at least partially conical such that an internal diameter of the passage opening decreases in the direction of the contact surface.

9. The lighting device as claimed claim 1, wherein the passage opening wall has at least one circumferential step protruding radially inward.

10. The lighting device as claimed in claim 1, wherein the passage opening wall has a coating which increases a leakage current resistance.

11. The lighting device as claimed in claim 1, wherein the passage opening has a sleeve formed with the housing, which extends from the housing wall in the direction of the contact surface.

12. The lighting device as claimed in claim 1, wherein at least two of the passage openings have different diameters.

13. A lighting device, comprising:

a power setting unit for setting an electrical power of a light source electrically coupled to the power setting unit, a programmable control unit connected to the power setting unit for controlling the power setting unit, a light control interface unit connected to the control unit for supplying a control signal for setting the power of the power setting unit, and a housing made of an electrically insulating material, which provides a power connection for connecting to an electrical power supply network, and which housing encloses at least the power setting unit and the programmable control unit so that they are protected from touch, wherein the control signal is predefinable via the light control interface from outside the housing, wherein the programmable control unit comprises:

a programming interface having at least two contact surfaces for electrically contacting the programming interface, an isolation unit for the programming interface; and wherein the housing has an associated passage opening in a housing wall for each contact surface arranged opposite to the associated contact surface, wherein each passage opening has a diameter of less than or equal to 2.5 mm and a respective passage opening wall of the passage opening has an axial length of greater than or equal to 3 mm; wherein the passage opening wall has at least one circumferential step protruding radially inward.

14. A lighting device, comprising:

a power setting unit for setting an electrical power of a light source electrically coupled to the power setting unit, a programmable control unit connected to the power setting unit for controlling the power setting unit, a light control interface unit connected to the control unit for supplying a control signal for setting the power of the power setting unit, and a housing made of an electrically insulating material, which provides a power connection for connecting to an electrical power supply network, and which housing encloses at least the power setting unit and the programmable control unit so that they are protected from touch, wherein the control signal is predefinable via the light control interface from outside the housing, wherein the programmable control unit comprises:

a programming interface having at least two contact surfaces for electrically contacting the programming interface, an isolation unit for the programming interface; and wherein the housing has an associated passage opening in a housing wall for each contact surface arranged opposite to the associated contact surface, wherein each passage opening has a diameter of less than or equal to 2.5 mm and a respective passage opening wall of the passage opening has an axial length of greater than or equal to 3 mm; wherein the passage opening wall has a coating which increases a leakage current resistance.

* * * * *